US005100038A

United States Patent [19]

Schäfer

[11] Patent Number: 5,100,038

[45] Date of Patent: Mar. 31, 1992

[54] TICKET DISPENSING STRUCTURE

[76] Inventor: Christopher E. Schafer, R.R. 2, Adair, Iowa 50002

[21] Appl. No.: 614,667

[22] Filed: Nov. 16, 1990

Related U.S. Application Data

[62] Division of Ser. No. 285,682, Dec. 16, 1988, Pat. No. 4,995,507.

[51] Int. Cl.[5] ..... B26F 3/02; B65D 83/12

[52] U.S. Cl. ..... 225/32; 225/43; 225/52

[58] Field of Search ..... 225/32, 39, 43, 52, 225/53, 54, 77, 90, 84, 92; 206/39, 39.7

[56] References Cited

U.S. PATENT DOCUMENTS

| | | | |
|---|---|---|---|
| 978,052 | 12/1910 | Oehring | 225/32 |
| 1,379,756 | 5/1921 | Friend | 225/32 |
| 1,400,619 | 12/1921 | Marcuse | 225/32 |
| 1,658,608 | 2/1928 | Marcuse | 225/32 |
| 2,207,873 | 7/1940 | Parr | 225/84 |
| 2,809,082 | 10/1957 | Marcuse | 225/32 |
| 2,887,247 | 5/1959 | Williams, Jr. | 225/32 |
| 4,858,806 | 8/1989 | Schafer | 225/32 |

*Primary Examiner*—Hien H. Phan
*Attorney, Agent, or Firm*—Henderson & Sturm

[57] ABSTRACT

The disclosed ticket dispenser is especially designed for the dispensing of series-connected lottery tickets and provides a box-like structure for containing the tickets which are exited through a slot in one of the structure walls. The structure is configured so as to provide guide and ticket-tensioning elements about the slot and further includes wings closing the slot at opposite edges. The wall of the structure in which the slot is provided is hinged to the rest of the structure and has a lockable catch releasable to afford access to the interior of the structure. Portions of the structure are shaped in such fashion as to prevent or minimize interior obstructions to the free travel of tickets via manual tensioning forces applied exteriorly of the structure.

1 Claim, 2 Drawing Sheets

Fig. 1
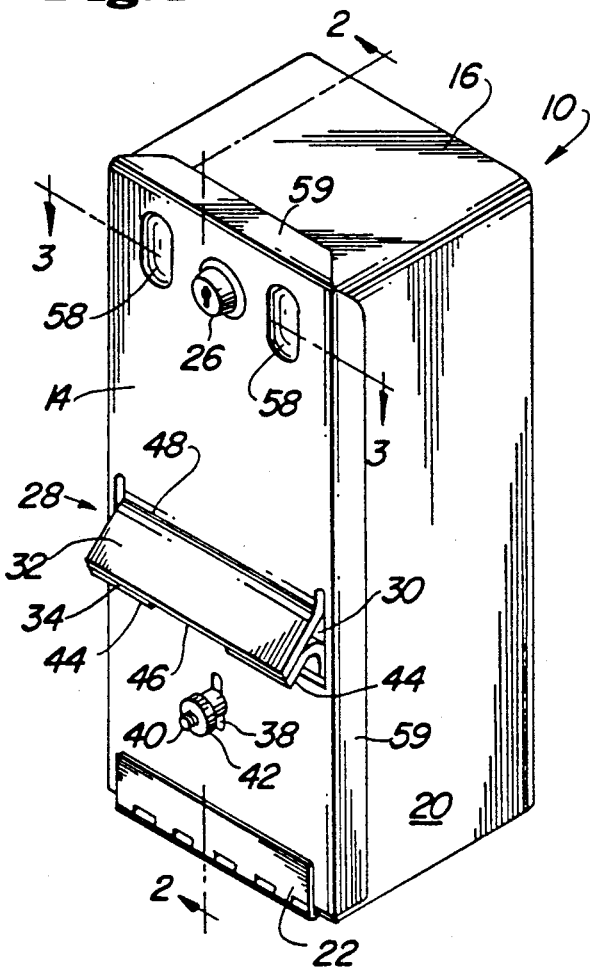
Fig. 2
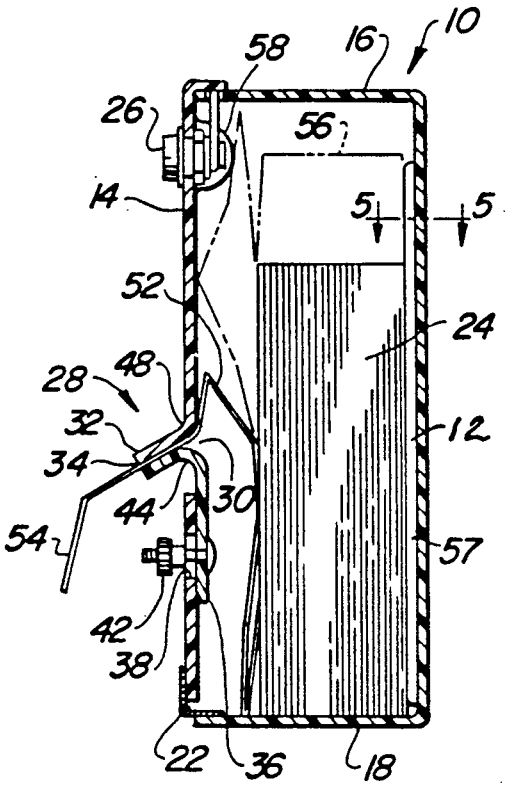
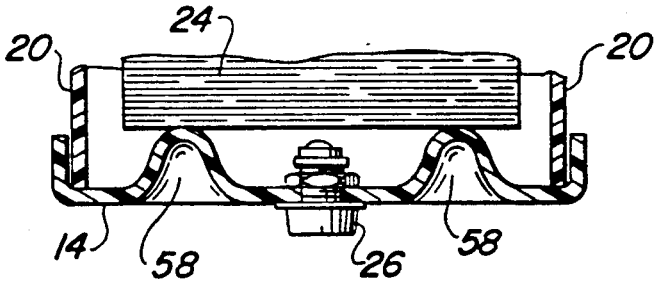
Fig. 3
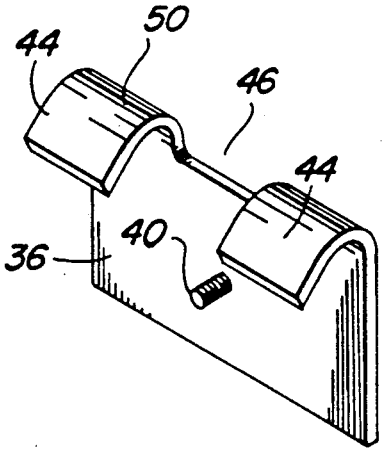
Fig. 4
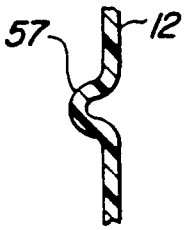
Fig. 5

TICKET DISPENSING STRUCTURE

This application is a division of co-pending application Ser. No. 07/285,682, filed Dec. 16, 1988 is now U.S. Pat. No. 4,995,507.

BACKGROUND AND SUMMARY OF THE INVENTION

Various forms of lottery and like ticket dispensers are known, most if not all possessing certain fundamental attributes; e.g., transparent walls through which the stack of tickets may be seen, provision for safeguarding the dispenser against unauthorized removal of tickets, means for attaching the dispenser to a counter or like support and the provision of a slot through which the tickets may be manually extracted. Known machines or dispensers suffer from various faults and disadvantages; such as high initial cost, complicated dispensing systems, vulnerability to tampering, large space-consuming dimension and the like.

According to the present invention, the foregoing and other disadvantages are eliminated by the provision of a simple, low-cost but durable structure so dimensioned as to occupy minimum mounting space, as on a counter or the like and so configured as to assure convenient trouble-free extraction of tickets. A significant feature is that the slot through which the tickets are manually extracted is bordered by lip and flange elements that guide the exiting tickets accurately and that further prevent unauthorized extraction of tickets. The slot is defined by cooperative wall elements between which the tickets must pass; and these wall elements are relatively adjustable to vary the tension on the ticket series or chain. This tension provides control of the tickets when separating dispensed tickets from the stack and helps to prevent damage to tickets which can occur when separating. Still further, the interior of the box-like structure in which the stack of tickets is confined is shaped in such fashion as to eliminate or minimize obstructions to the free flow of tickets.

Additional features and advantages will become apparent as preferred embodiments of the invention are disclosed in the ensuing description when taken with the accompanying drawings.

DESCRIPTION OF THE DRAWINGS

FIG. 1 is a perspective of the dispenser.

FIG. 2 is a section as seen along the line 2—2 of FIG. 1.

FIG. 3 is an enlarged section as seen along the line 3—3 of FIG. 1.

FIG. 4 is a perspective, on an enlarged scale, of one of the components of the ticket exit means.

FIG. 5 is an enlarged fragmentary section on the line 5—5 of FIG. 2.

DETAILED DESCRIPTION OF PREFERRED EMBODIMENTS OF THE INVENTION

Figure 6:
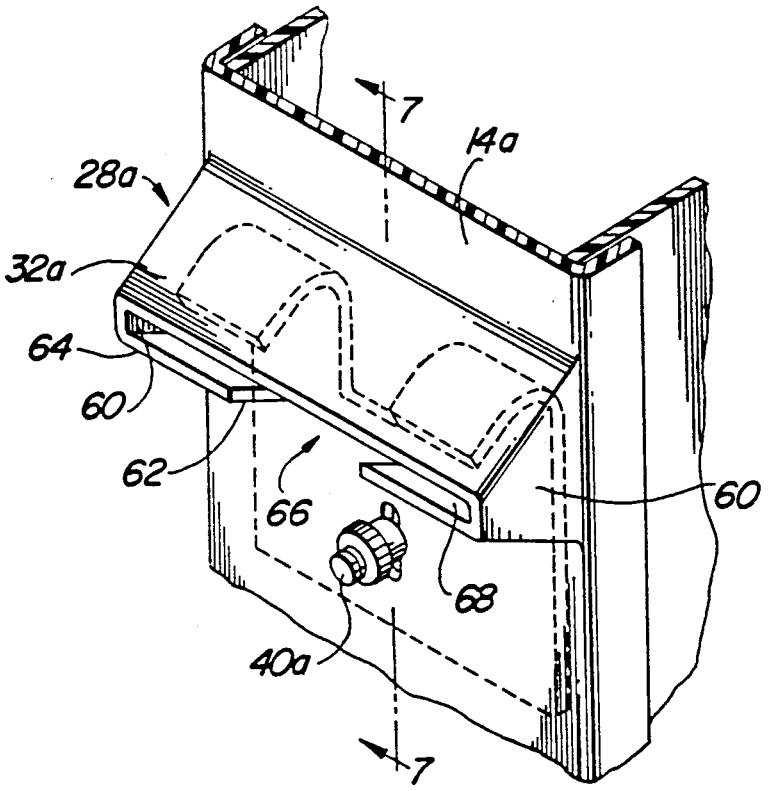
FIG. 6 is a fragmentary perspective of a modified form of dispensing means.
Figure 7:
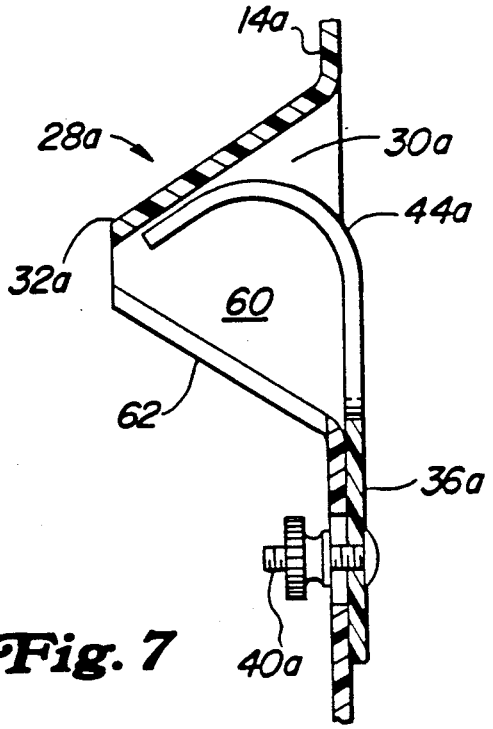
FIG. 7 is a section taken along the line 6—6 of FIG. 5.

The dispenser chosen for purposes of disclosure is a box-like structure 10 having front and rear walls 12 and 14, a top 16, a bottom 18 and opposite side walls 20. The walls are integrally formed, with the exception of the rear wall, which is hinged at its lower portion by a hinge 22 to the bottom wall, of rigid, high-impact transparent plastic of any suitable type. The use disposition of the dispenser is as shown; i.e., its long dimension vertical. The small area of the bottom means that the dispenser occupies a relatively small space on a counter, for example, and further enables the use of the dispensers in side-by-side multiples; alternatively, they may be stacked vertically with suitable adhesive or the like to hold them in place. The walls are typically transparent so that purchasers may easily see the tickets within the dispenser. In the present case, a stack 24 of tickets is shown, arranged conventionally in front-to-rear, top-to-bottom zig-zag fashion, with the tickets in series or chain fashion interconnected at tear lines which in effect provide hinges for the folding and unfolding of the zig-zag tickets as they travel to and through a ticket exit to be described later herein. The designation of the walls as front and rear is based on the use of the dispenser in the upright mode referred to above, in which the solid or fixed wall 12 is to the front and the hinged wall 14 to the rear or easily accessible to the personnel in charge of selling the tickets. The top part of the rear wall 14 is equipped centrally thereof with a key-controlled lock 26.

The rear wall is provided intermediate its ends with ticket exit means generally designated 28. This means provides a transverse slot 30. In a preferred dispenser having a height of between eleven and eleven and one-half inches, the slot will be spaced on the order of $4\frac{3}{4}$ to $5\frac{1}{4}$ inches above the bottom 18, which location provides excellent ticket exiting. The means 28 includes as one of its components a lip 32 integral with the rear wall and extending rearwardly and downwardly in overhanging relation to the slot 30. The lower rear edge of the lip affords a sharp cut-off or tear-off element 34, it being understood that as the tickets are manually drawn rearwardly through the slot, they will be torn off along the tear lines previously referred to. The lip assists in the downward and rearward discharge of the tickets and thus facilitates their tearing off by upward force.

The cooperative part of the means 28 that functions in conjunction with the lip 32 is a lower portion or gate 36 (FIG. 4) which is vertically adjustably carried by the wall 14 below the lip. The adjustability flows from the use of a vertical slot 38 in the wall 14 and rearwardly projecting threaded stud 40 rigid with the gate 36 and projecting through the vertical slot to receive a threaded knob 42. The top portion of the gate is bifurcated or otherwise provided with rearwardly and downwardly curved furcations or guides 44 that cooperate with the undersurface of the lip 32 to define the critical portions of the slot 30, the thickness of which may be selectively varied by adjustment of the gate via the knob or fastener 42. This variation will accommodate ticket thicknesses that may vary from stack to stack. The gap 46 opens upwardly to the undersurface of the lip 32 as well as forwardly to the interior of the dispenser as an aid to facilitating manual clearing of minor ticket hang-ups. The lip 32 joins the wall 14 in a smoothly rounded junction 48 on a radius on the order of one-half inch and the slope of the lip relative to the wall 14 is on the order of forty-five to seventy degrees as measured below the lip. The curvature of each of the guides 44 on the gate 36 is also such as to afford a smoothly rounded transition or junction, the radius at 50 in each case being on the order of one to one and one-fourth inches. The curvature about this radius begins at the inner or front plane or surface of the rear wall 14. As best seen in FIG. 2, the configuration afforded by the radii just described enables smooth flow of the tickets through the slot, as best indicated by the ticket portions 52 and 54 respectively within and exteriorly of the dispenser. Smooth flow in this respect is desirable from the standpoint of preventing scratching or otherwise marring of the surfaces of the tickets, typically of a latex or like coating.

Although it may be expected that the tickets will unfold in a constant pattern as the leading tickets are extracted through the exit means 28, that is not always the case, especially when longer or higher ticket stacks are used. The stack 24 has a height of about seven and one-half inches. Taller stacks of ten inches are also used and one such stack is shown in broken lines at 56. As seen, the path of tickets from a taller approaches the top interior of the dispenser as well as the top interior of the rear wall 14, especially in the vicinity of interior portions of the lock 26. In order to prevent the tickets from tangling with or being obstructed by the interior lock portion, the top part of the rear wall is formed with interior ramps 58 which straddle the lock inside part so as to smoothly guide the tickets 56 away from entanglement with the lock. The ramps are preferably integral with the rear wall, being formed as forwardly projected "dimples".

The side and top edges of the rear wall are flanged at 59 to overlap adjacent portions of the side and top walls of the dispenser for guarding against unauthorized access to the interior of the dispenser as well as for adding rigidity to the rear wall. Of course, authorized access to the dispenser is available via the lock and hinged rear wall, as for adding tickets, etc. Another feature is the use of vertical ribs 57 on the inside of the front wall (FIGS. 2 and 5) to smooth out the ticket movement and to minimize scratching of the front wall.

Another function of the gap 46 in the top of the gate 36 is to enable the authorized user of the dispenser to finger-engage a ticket to assist in on its way through the exit, considering that the ticket passing the tear-off edge of the lip will be torn off at that edge and the next ticket will lie under the lip.

In the modified form of the invention shown in FIGS. 5 and 6, the basic structure will be as before and reference numerals used previously will be suffixed with the letter "a" to correlate the common parts. Thus the rear wall is shown at 14*a* as having ticket exit means 28*a* defining an exit slot 30*a* by means of a lip 32*a* and adjustable portion or gate 36*a* via 40*a*. The upper configuration of the gate is as before, providing the curved parts 44*a*, all shaped with radii as before, unnecessary to describe again in detail. The improvement in the modification is provided by means affording at least partial enclosure of the slot means 28*a* and thus added strength to the structure and better control of the tickets as to exit as well as to improve protection against unauthorized access to the exit slot. To this end, then, the rear wall has integral therewith a pair of laterally spaced apart, rearwardly projecting wings 60 lying respectively alongside opposite sides of the slot 30*a*. The wings are here of triangular shape and integral adjoin opposite sides of the lip 32*a*. In addition, the rear wall 14*a* has an integral wall element 62 that slopes upwardly and rearwardly and terminates at 64 just below the tear-off edge of the lip and having an access gap 66 for accommodating operator or user access to the tickets as before relative to the gap 46. The arrangement is such as to provide a secondary exit slot 68 and further to enclose the slot 30*a* from the sides and to substantially enclose that slot from the rear and below. The additional wall element and wings further add rigidity to the slot means 28*a* and all corners are rounded to avoid sharp edges except at the tear-off.

The use and operation of both forms of the disclosed dispenser are thought to be clear from the foregoing, along with features incident to the description of the dispenser and its components. Features and objects additional to those pointed out will readily occur to those versed in the art, along with variations in the preferred forms disclosed, all without departure from the spirit and scope of the invention.

I claim:

1. A dispenser for series-connected tickets, comprising a box-like structure having front, rear, side, top and bottom walls, means on the rear wall intermediate the top and bottom walls providing a transverse slot through which the tickets are extracted via a rearwardly directed manual force applied to the leading ticket, said means having an upper portion defining the top of the slot and including a rearwardly directed lip rigid with the rear wall and disposed in overhanging relation to the slot and terminating in a transverse cut-off edge, said means further having a lower portion providing a ticket guide attached to the structure and having upper surface elements beneath the underside of the lip and cooperating with said underside so as to frictionally engage a ticket drawn through the slot, wings at opposite ends of the lip and rigidly connecting the ends of the lip respectively to the structure adjacent to the side walls, and a wall element joined to the rear wall at a junction spaced below the slot and sloping upwardly and rearwardly from that junction and terminating below the rear edge of the lip and joined to the wings.

* * * * *